United States Patent [19]

Bahder et al.

[11] 4,218,577

[45] Aug. 19, 1980

[54] TELEPHONE SERVICE WIRE WITH ESTER-BASED FILLING COMPOUND

[75] Inventors: George Bahder, Edison; Paul F. Thompson, Millington, both of N.J.

[73] Assignee: General Cable Corporation, Greenwich, Conn.

[21] Appl. No.: 59,325

[22] Filed: Jul. 20, 1979

[51] Int. Cl.[2] ..... H01B 7/28

[52] U.S. Cl. ..... 174/23 C; 174/110 PM; 252/63

[58] Field of Search ..... 174/23 C, 23 R, 110 PM, 174/116; 156/48; 252/63, 64

[56] References Cited

U.S. PATENT DOCUMENTS

| | | | |
|---|---|---|---|
| 3,607,487 | 9/1971 | Biskeborn | 174/23 C |
| 3,638,306 | 2/1972 | Padowicz | 174/107 |
| 3,642,638 | 2/1972 | Kitano | 252/63 |
| 3,733,427 | 5/1973 | Clark et al. | 174/110 PM X |
| 3,888,709 | 6/1975 | Burk | 174/23 C X |
| 3,888,710 | 6/1972 | Burk | 174/110 PM X |
| 3,944,717 | 3/1976 | Hacker et al. | 174/23 C |
| 4,104,480 | 8/1978 | Thompson | 174/23 C |
| 4,105,619 | 8/1978 | Kaufman et al. | 174/23 C X |

*Primary Examiner*—Arthur T. Grimley

*Attorney, Agent, or Firm*—Roy C. Hopgood; John M. Calimafde; Charles W. Neill

[57] ABSTRACT

This telephone service wire has metal conductors insulated with polyethylene plastic insulation or equivalent, assembled in a core having a flame-retardant polyvinyl chloride jacket. Space between the individual insulated conductors is filled with an improved filling compound for preventing access of water into the core of the service wire. The filler compound is an ester-based compound that avoids the disadvantages of the usual petrolatum-based filler compound which extracts not only antioxidants and copper-inhibitors from a polyethylene component but plasticizers from a polyvinyl chloride compound. Depletion of these essential compounding materials can seriously affect the physical characteristics of either the insulation or jacket of such filled telephone service wires.

11 Claims, 1 Drawing Figure

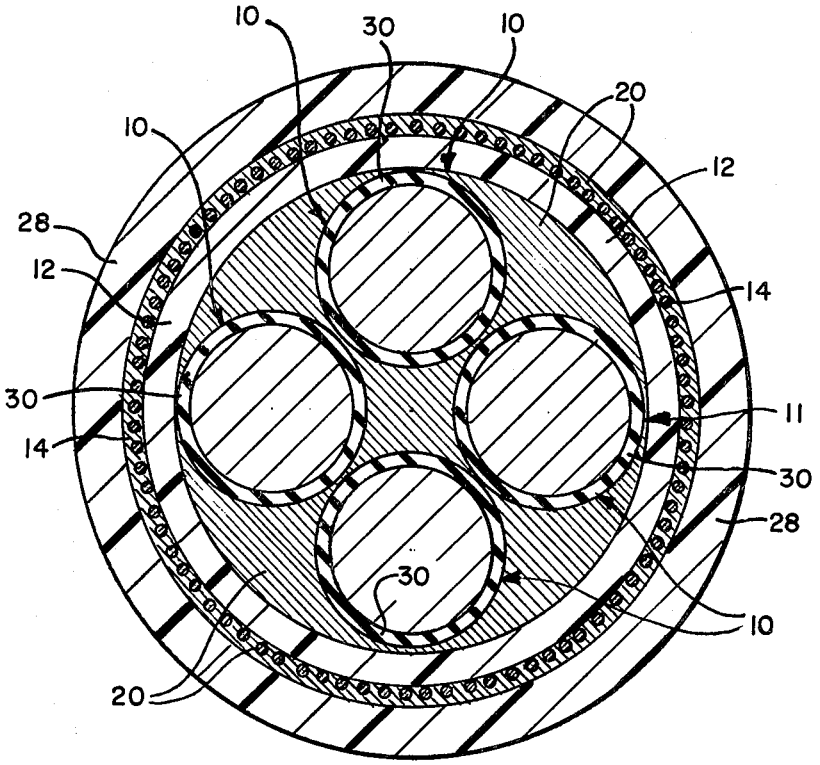
10
30
10
20
10
12
28
12
14
30
11
14
30
28
30
10
20

TELEPHONE SERVICE WIRE WITH ESTER-BASED FILLING COMPOUND

BACKGROUND AND SUMMARY OF THE INVENTION

What is needed is a filler compound that is compatible with both polyethylene and polyvinyl chloride compounds. Filled service wire requires a flame-retardant polyvinyl chloride jacket. The new filler compound of this specification is based on a plasticizer system that is commonly used in the manufacture of flame-retardant polyvinyl chloride compounds. This filling compound is designed primarily for use in a high density polyethylene insulated and polyvinyl chloride jacketed buried telephone service wire, and is based on the retention of the physical properties of polyethylene insulation and polyvinyl chloride jacket compounds after immersion in the filler compound at elevated temperatures, fluidity at the accepted processing temperature of 121° C., resistance to dripping at elevated temperatures, commonly referred to as the "drip point," and adhesiveness to cable components and resistance to cracking at room and lower temperature.

Other objects, features and advantages of the invention will appear or be pointed out as the description proceeds.

BRIEF DESCRIPTION OF DRAWING

The drawing is an enlarged cross-section of a telephone service wire containing the filler material of this invention in the spaces between the individual insulated conductors.

DESCRIPTION OF PREFERRED EMBODIMENT

The filler compound of this specification includes one or more esters compounded with wax and polyethylene or chlorinated polyethylene. Amorphous polypropylene is used with some of the examples. Limited amounts of petrolatum are used with most of the preferred embodiments in amounts up to about 25% of the filler. The petrolatum is solidified with a low density polyethylene.

In each of the formulations given as examples of the filler of this specification, the ingredients will be identified by their laboratory designations, and more specific identification, and source for the items will follow the examples.

EXAMPLE I

This example is a formulation of 60 parts of (DIDP) ester plasticizer; 40 parts of (TINTM), another ester plasticizer 12 parts of chlorinated polyethylene; 10 parts of another wax (XFQ); 16 parts amorphous polypropylene; and these ingredients are blended into about 40 parts of petrolatum. After thorough mixing with the 40 parts of petrolatum, the filler had a drip point of 80° to 85° C. and withstood the standard low temperature bend test without cracking at −44° C.

DIDP is diisodecyl phthalate, and TINTM is tri-isononyl-trimellitate. These ingredients are made by Exxon Chemicals of Houston, Tex. The wax XFQ is a polyolefin was available from Western Petro Chemical of Chanute, Kans. and chlorinated polyethylene from Dow Chemical of Baton Rouge, La.

EXAMPLE II

The filler of this example was made with 80 parts of ester plasticizer (DOP) and 20 parts of ester plasticizer (TINTM); 10 parts of polyolefin wax (XFQ); 20 parts of amorphous polypropylene; 5 parts of polyethylene; and 40 parts of "Q-9" which consists of approximately 89.8 parts of petrolatum; 9 parts of low density polyethylene; 1 part of butyl rubber; and 0.2 parts of antioxidant. This Q-9 formulation is available from the Witco Chemical Corporation of Petrolia, Pa. The DOP is available from Exxon Chemicals. The amorphous polypropylene was obtained from Eastman Chemical Products in Kingsport, Tenn.

EXAMPLE III

This example uses the same amount of ester plasticizers as in Example I but in somewhat different proportions; i.e., 66 parts of DIDP and 34 parts of TINTM. 5 parts of chlorinated polyethylene was used, and 5 parts of the wax XFQ. The formulation also contains 5 parts of amorphous polypropylene, 5 parts of polyethylene and 5 parts of polyvinyl chloride. Minor ingredients included one part each of materials designated in the laboratory notes as "224" and "517." These ingredients are Mark 224, an epoxy stabilizer for PVC, and Mark 517, a phosphite stabilizer also for PVC. Both stabilizers were obtained from Argus Chemicals of Brooklyn, N.Y. The polyvinyl chloride was obtained from Tenneco Chemical of Burlington, N.J.

Example III had a drip point of 110° C., 5° higher than Example II, and about 25° higher than Example I. The low temperature bend test did not crack at −40° C., which was a few degrees higher than the bend test for Example II.

EXAMPLE IV

In this example, 90 parts of polybutene were added to the formulation, and the ingredients of Example III were used but with an increase in the XFQ wax from 5 to 19 parts and an increase in the amorphous polypropylene from 5 to 18 parts. The drip point remained at 110° C., and the low temperature bend test was satisfactory at −40° C.

EXAMPLE V

In this example, 100 parts of TINTM ester plasticizer was used but no other ester plasticizers were used. 8 parts of chlorinated polyethylene were used and 10 parts of the wax XFQ. 3.6 parts of amorphous polypropylene were used in this example, and 35.8 parts of the petrolatum Q-9. The drip point was reduced to 80° C., but the low bend test was still satisfactory at −40° C.

EXAMPLE VI

This example differed from Example V in that the amorphous polypropylene was omitted, and the Q-9 was increased to 39 parts. The drip point was somewhat lower than any of the other examples, but the low temperature bend test was satisfactory at −45.5° C. Thus the formulation of Example VI was not as good as the other examples at the high temperature conditions under which the cable might be used but was better at the low temperature environments.

All of the above examples were satisfactory filling compounds for the telephone service cable. Their ingredients were compatible with the polyvinyl chloride jacket. In those formulations where Q-9 petrolatum was used (Examples I, V and VI), there was not enough petrolatum to extract the plasticizers from the PVC compound of the cable jacket.

The drawing is a sectional view through a telephone service cable which is made with insulated conductors 10 crowded together in a core 11 and surrounded by a plastic jacket 12 of polyvinyl chloride, polyethylene or other suitable jacketing material. Such telephone service cables are commonly made with and without metal armor 14 surrounding the group of insulated conductors 10. The spaces around the insulated conductors 10 and within the inner jacket 12 are filled with the ester-based filling compound of this specification. In an armored construction, an outer plastic jacket 28, which is preferably polyvinyl chloride or an equivalent plastic composition which resists abrasion, surrounds the armor 14, and any clearance between the armor 14 and the outer jacket 28 is filled with the ester-based filler composition 20.

The insulated conductors 10 touch adjacent insulated conductors 10 at points of tangency. The insulation of conductors 10 is indicated by the reference characters 30, and the space between the insulated conductors, where they do not touch other conductors, is filled with the filler composition 20 of this specification. The drawing shows a cable with two jackets but the filler can be used also with cables having only one jacket.

All of the examples of the filler material described in this specification have adhesive qualities which cause them to adhere to the insulation of the conductors 10; and this adhesion also holds the material of the filler together. The adhesion is maintained over the full temperature range from the drip point down to the lowest temperature for which the filler is intended to be used. Ordinarily, this temperature is −40° C. and commercial standards require that telephone service cables have the flexibility to be bent under installation conditions without having the cable or the filler material crack at the region of bending.

Preferred embodiments of this invention have been described in detail, but changes and modifications may be made in the filler formulation without departing from the invention as defined in the claims.

What is claimed is:

1. A telephone service cable including a plurality of insulated electrical conductors, a plastic jacket surrounding the plurailty of conductors, and a filling compound within the jacket and in contact with the insulated electrical conductors, said filling compound being adhesive within a range from about 70° C. to about −40° C. so as to adhere to the insulated conductors and to itself, said filling compound containing 100 parts of ester-type plasticizer, about 5 to 20 parts of wax having a melting point of about 70 to 150° C., and about 1 to 25 parts of polyethylene.

2. The telephone service cable described in claim 1 characterized by some of the polyethylene being in the form of chlorinated polyethylene.

3. The telephone service cable described in claim 1 and in which at least some of the polyethylene is a low molecular weight polyethylene resin.

4. The telephone service cable described in claim 1 characterized by the filler compound containing from about 5 to 36 parts of amorphous polypropylene.

5. The telephone service cable described in claim 1 characterized by the filler containing about 0.2 to 0.6 parts of antioxidant.

6. The telephone service cable described in claim 1 characterized by the filler containing about 10 to 40 parts of petrolatum.

7. The telephone service cable described in claim 6 characterized by about 89.8 parts of the petrolatum being mixed with 9 parts of low to medium density polyethylene; 1 part butyl rubber and 0.2 parts of antioxidant.

8. The telephone service cable described in claim 7 characterized by the filler containing up to 90 parts of polybutene with an average molecular weight of about 3000.

9. The telephone service cable described in claim 1 characterized by the filler including material from the group consisting of 40 parts of low molecular weight polyisobutylene rubber and a copolymer of isobutylene and isoprene rubber.

10. The telephone service cable described in claim 1 characterized by the filler containing up to 10 parts of polyvinyl chloride dispersion resin.

11. The telephone service cable described in claim 2 characterized by the chlorinated polyethylene being up to 10 parts of the filler.

* * * * *